US009909812B2

(12) United States Patent
Peskos et al.

(10) Patent No.: US 9,909,812 B2
(45) Date of Patent: Mar. 6, 2018

(54) HEAT EXCHANGER

(71) Applicant: Modine Manufacturing Company, Racine, WI (US)

(72) Inventors: Thomas Peskos, Racine, WI (US); Rainer Glück, Tübingen (DE)

(73) Assignee: Modine Manufacturing Company, Racine, WI (US)

( * ) Notice: Subject to any disclaimer, the term of this patent is extended or adjusted under 35 U.S.C. 154(b) by 563 days.

(21) Appl. No.: 14/388,664

(22) PCT Filed: Mar. 28, 2013

(86) PCT No.: PCT/US2013/034494
§ 371 (c)(1),
(2) Date: Sep. 26, 2014

(87) PCT Pub. No.: WO2013/149087
PCT Pub. Date: Oct. 3, 2013

(65) Prior Publication Data

US 2015/0047818 A1 Feb. 19, 2015

(30) Foreign Application Priority Data

Mar. 28, 2012 (DE) ..... 10 2012 006 346

(51) Int. Cl.
*F28D 1/02* (2006.01)
*F28F 3/08* (2006.01)
(Continued)

(52) U.S. Cl.
CPC ..... *F28D 9/0062* (2013.01); *F28D 9/0037* (2013.01); *F28D 9/0031* (2013.01);
(Continued)

(58) Field of Classification Search
CPC .... F28D 9/0031; F28D 9/0043; F28D 9/0056; F28D 9/0062; F28D 9/0075; F28F 9/0263; F28F 9/0268
(Continued)

(56) References Cited

U.S. PATENT DOCUMENTS 5,062,477 A * 11/1991 Kadle ..... B60H 1/3227 165/152
5,400,854 A * 3/1995 Iio ..... F28D 9/0043 165/157
(Continued)

FOREIGN PATENT DOCUMENTS

CH 692760 A5 10/2002
DE 2322730 11/1974
(Continued)

OTHER PUBLICATIONS

Translation of JP 61027496 A entitled Translation-JP 61027496 A.*
(Continued)

*Primary Examiner* — Len Tran
*Assistant Examiner* — Paul Alvare
(74) *Attorney, Agent, or Firm* — Michael Best & Friedrich LLP

(57) ABSTRACT

The disclosure relates to a heat exchanger, for example an indirect air cooler, in which the air, for example compressed charge air for an internal combustion engine, is cooled, for example by a fluid, wherein the heat exchanger is constructed from stacked pairs of plates. The exemplary fluid can be conducted into an inlet region and/or outlet region of the plate pairs in at least one flow path approximately in the direction of the common edge, and further through at least a first duct approximately in cross current with respect to the exemplary air, and passes further through the plate pairs over the largest heat exchange area of the plate pairs approxi-
(Continued)

mately in countercurrent with respect to the air, in order to flow through at least one second duct, approximately in cross current with respect to the exemplary air, and back to the outlet.

13 Claims, 7 Drawing Sheets

(51) Int. Cl.

| | |
|---|---|
| ***F28F 3/14*** | (2006.01) |
| ***F28F 3/00*** | (2006.01) |
| ***F28D 9/00*** | (2006.01) |
| *F28F 9/02* | (2006.01) |
| *F28D 21/00* | (2006.01) |
| *F28F 3/02* | (2006.01) |
| *F28F 3/06* | (2006.01) |

(52) U.S. Cl.
CPC ..... *F28D 9/0043* (2013.01); *F28D 9/0056* (2013.01); *F28D 9/0075* (2013.01); *F28D 2021/0082* (2013.01); *F28F 3/027* (2013.01); *F28F 3/06* (2013.01); *F28F 9/0263* (2013.01); *F28F 9/0268* (2013.01)

(58) Field of Classification Search
USPC ..... 165/153, 166, 167, 170
See application file for complete search history.

(56) References Cited

U.S. PATENT DOCUMENTS 5,810,077 A * 9/1998 Nakamura ..... F25B 39/024 165/153
5,875,838 A * 3/1999 Haselden ..... F28D 9/0043 165/146
5,983,992 A * 11/1999 Child ..... F28D 9/0043 165/153
8,016,025 B2 * 9/2011 Brost ..... F02B 29/0462 165/149
8,985,198 B2 * 3/2015 Braun ..... F02B 29/0462 165/149
2001/0054499 A1 * 12/2001 Gerard ..... F25J 5/002 165/166
2006/0249281 A1 * 11/2006 Park ..... F28D 1/0341 165/153
2007/0074859 A1 * 4/2007 Nakada ..... F28D 1/0375 165/153
2008/0066893 A1 * 3/2008 Oh ..... F28D 1/0341 165/153
2008/0087410 A1 4/2008 Muller-Lufft et al.
2008/0141985 A1 * 6/2008 Schernecker ..... F02M 26/32 123/568.12
2008/0149318 A1 * 6/2008 Dakhoul ..... F28F 3/086 165/167
2009/0014153 A1 1/2009 Pimentel et al.
2010/0300647 A1 12/2010 Steurer et al.

FOREIGN PATENT DOCUMENTS

DE 19646349 5/1998
DE 102005013922 A1 * 9/2006 ..... F02B 29/0437
DE 102005053924 5/2007
DE 102006048667 A1 4/2008
DE 102009048060 4/2010
JP 61027496 A * 2/1986 ..... F28D 1/0341
JP H08-145589 6/1996
JP 2011-149671 4/2011

OTHER PUBLICATIONS

First Office Action from The State Intellectual Property Office of China for Application No. 201380016383.5 dated Dec. 2, 2015 (16 pages).
International Search Report; PCT/US2013/034494: dated Jun. 27, 2013; 2 pgs.
Written Opinion; PCT/US2013/034494: dated Jun. 27, 2013; 5 pgs.
Office Action from The Japanese Intellectual Property Office for Application No. 2015-503618 dated Dec. 14, 2016 (10 pages).
Second Office Action from The Japanese Intellectual Property Office for Application No. 2015-503618 dated Jun. 28, 2017 (11 pages).

* cited by examiner

HEAT EXCHANGER

CROSS-REFERENCE TO RELATED APPLICATIONS

This application is a national stage filing under 35 U.S.C. 371 of International Patent Application No. PCT/US2013/034494 filed on Mar. 28, 2013, which claims priority to German Patent Application No. DE102012006346.6, filed Mar. 28, 2012, the entire contents of which are hereby incorporated by reference.

BACKGROUND

The present disclosure relates to a heat exchanger.

SUMMARY

The disclosure relates to a heat exchanger, for example an indirect air cooler, in which the air, for example compressed charge air for an internal combustion engine, is cooled, for example, by means of a fluid, wherein the heat exchanger is constructed from stacked pairs of plates with fins arranged therebetween, and the stack is arranged in a housing to which the air flows, flows through the fins and flows out, wherein said air is cooled by the fluid flowing in the plate pairs, which fluid is conducted into the plate pairs via at least one inlet and conducted away via at least one outlet, wherein the inlet and the outlet are located at a common edge of the plates and the air flows through the fins approximately in the direction of this edge.

Charge air coolers which are installed in motor vehicles and serve to cool the charge air by means of a cooling fluid are often referred to as indirect air coolers, in contrast to direct air coolers, a term used when the exemplary charge air is cooled with ambient air which is conveyed through the cooler by means of a fan.

The cooling fluid used is cooled directly by means of cooling air and is then used for cooling the engine as well as for other cooling purposes, and recently also to a greater extent for (indirect) charge air cooling.

The efficiency of the transmission of heat is known to be highest if the media are conducted through the heat exchanger in countercurrent (DE 29 809 080 U1). However, a throughflow in countercurrent is not always possible depending on the locality in which the air cooler (heat exchanger) is located and on other restrictions. The positions of the inlets and outlets can actually rarely be defined in such a way that the preferred throughflow can also occur or the actualization thereof often requires excessively high complexity in terms of design and construction.

For this reason, sometimes what is referred to as countercurrent or often cross countercurrent is selected in which, for example, at least one of the media describes a meandering path. An example of cross-countercurrent can be found in DE 10 2006 048 667 A1.

The object of the disclosure is to construct the described heat exchanger with simple structural features, that is to say features which are also manufacture-friendly, in such a way that said heat exchanger provides a relatively high level of efficiency.

The solution to this problem is obtained with a heat exchanger which has the features of Patent claim 1.

According to one aspect of the disclosure there is provision that the fluid can be conducted in an inlet region and/or outlet region of the plate pairs in at least one flow path approximately parallel to the air flow direction and/or of the common edge, flows further through at least a first duct approximately in cross current with respect to the air, and passes through the plate pairs over the largest heat exchange area of the plate pairs, substantially approximately in countercurrent with respect to the air, in order to flow through at least one second duct, approximately in cross current, back to the outlet.

There is preferably at least one inlet-side flow path and the inlet-side first duct as well as the at least one outlet-side second duct and also outlet-side flow path. In both flow paths, the preferred fluid flows approximately in the direction of the air. The lengths of the flow paths can be minimized by arrangement of the inlets and outlets at the corners of the plates. According to the present disclosure the entire mass flow of the fluid does not pass over the entire length of the ducts but instead a considerable portion thereof does. Shortly after the entry of the fluid into the at least one first duct, a partial flow already flows through the plate pairs in countercurrent with respect to the air via corrugated internal fins. The same applies to the at least one second duct which leads to the outlet-side flow path. The ducts have a relatively low flow resistance so that the regions of the plates which are remote from the outlet are also sufficiently involved in the exchange of heat. The cross-sectional geometry of the ducts can be of corresponding design so that sufficient involvement is achieved.

The largest heat-exchanging region of the plates is equipped with the corrugated internal fins. The corrugated internal fins can be embodied as lanced and offset fins, such as are used, for example, in the field of oil cooling and elsewhere. In such fins, parts of the corrugation edges are arranged offset alternately to the right and to the left. Breakthroughs or cutouts are present between the offset parts. They permit a throughflow in the longitudinal direction. If this direction is blocked, a throughflow in the lateral direction is also possible. The longitudinal direction is parallel to the direction of the corrugation edges here. The internal fins in the plate pairs have a significantly smaller pressure loss than in the lateral direction when throughflow occurs in the longitudinal direction.

The direction in which the corrugations of the corrugated internal fins run is preferably provided transversely with respect to the longitudinal direction of the plates so that the fluid can flow in the longitudinal direction with relatively little resistance along the offset corrugation edges. A significantly larger flow resistance is present in the direction in which the corrugations run, a direction which, as mentioned above, is located transversely with respect to the direction of the corrugation edges because the fluid must flow through the numerous breakthroughs or cutouts in the corrugation edges and in the process also experiences numerous changes in the direction of flow. Approximately the entire mass flow flows through one flow path which is formed near to the inlet and the outlet by means of a flow barrier. In the flow path, the fluid flows in countercurrent with exemplary air since the flow barrier is arranged approximately parallel to the lateral edges. This can be accepted because the proportion of the entire heat-exchanging area taken up by the portion of the inlet and outlet region including the flow paths in terms of area is very small. It is generally not significantly more than approximately 15%, with 3 to 12% being preferred. The flow barrier is also located relatively close to the one lateral edge of the plate pairs, which is referred to above as the common edge. At the ends of the flow barrier located opposite there is a hydraulic connection to the ducts. At the other lateral edge of the plate pairs there is preferably no such flow path or duct so that the fluid cannot escape or is forced to take the path through the internal fin which has greater pressure loss and is located in countercurrent with respect to the airflow.

Simulation calculations carried out by the Applicant have resulted in a significant increase in the heat exchange rate for the proposed heat exchanger compared to the prior art.

The disclosure will be described in exemplary embodiments with reference to the appended drawings. Further features of the disclosure can be found in the following description

DETAILED DESCRIPTION

In the perspective illustration (FIG. 1) of the heat exchanger, which is an indirect air cooler in the exemplary embodiment, the inlet 4 and the outlet 5 are located at the right-hand edges of metallic plates 1, which therefore represent the "common" edges E here. The inlet 4 is arranged at the end remote from the air inflow side AAir of the heat exchanger. The outlet 5 is, on the other hand, located closer to the inflow side of the charge air which is indicated by three block arrows. The inlet and outlet connectors have the reference symbols 40 and 50. The inlet and outlet cross sections have a circular shape in these embodiments. Instead of charge air, a mixture of charge air and exhaust gas or pure exhaust of an internal combustion engine (not shown) can also be present.

An advantage of the disclosure worth mentioning is that the inlet 4 and the outlet 5 can be located on opposite edges which would then constitute the "common" edges E, without changing the throughflow, as a result of which structural restrictions can be coped with better than hitherto. In the exemplary embodiment shown, these edges E are the lateral edges of the plates 1. Two parallel longitudinal edges of the plates 1 are located approximately perpendicularly on the lateral edges, wherein the terms are used merely to differentiate between the edges, but do not in any case mean that the longitudinal edges, as shown in the exemplary embodiment, are longer than the lateral edges. The edges can all have the same length. The lateral edges can also be longer than the longitudinal edges. The fact that the edges in the exemplary embodiment shown are straight and therefore approximately rectangular plates 1 are present is also not an important precondition for solving the stated problem. The edges can also be arcuate or embodied in some other way which deviates from a straight line.

Figure 1:
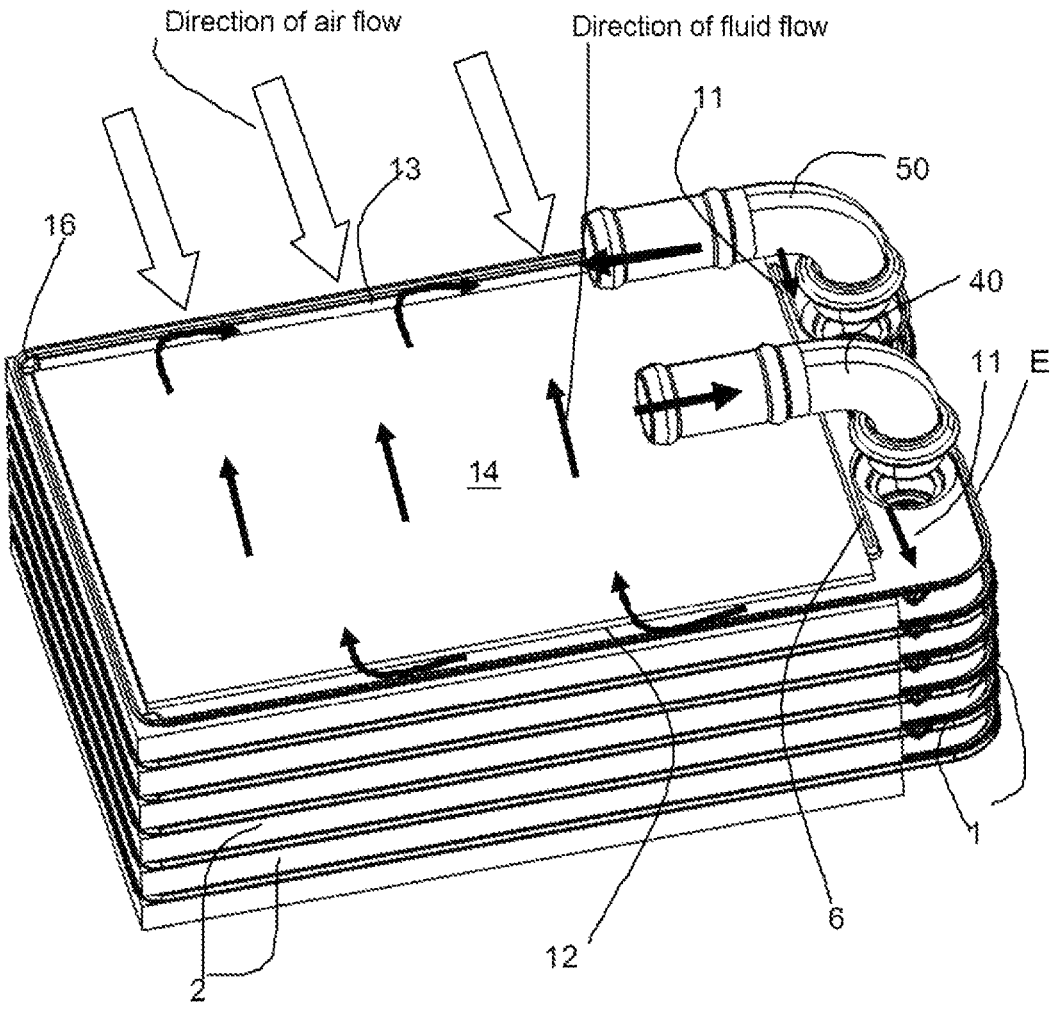
FIG. 1 shows a perspective view of the heat exchanger (illustrated without a housing).

In the exemplary embodiment shown, the plates 1 have a cutout 8 at the common edge E which is the right-hand lateral edge in FIG. 1. The depth of the cutout 8 is somewhat smaller than the depth of the inlet and outlet region 10. The position of the inlets and outlets 4, 5 is situated approximately in the center between the central longitudinal axis 15 of the plates 1 and their longitudinal edges. The inlet-side flow paths 11 extend from the inlets to the first ducts 12, which are arranged in the inner edge region of the one longitudinal edge in the plate pairs 1*a*, 1*b*. In the inner edge region of the other longitudinal edge there is the at least one second duct 13 which leads to the outlet-side flow path 11 and further to the outlet 5.

In the exemplary embodiment shown, the ducts 12, 13 have the same cross section throughout. The ducts 12, 13 have a low flow resistance, that is to say at least a partial cross section of the ducts 12, 13 does not have flow impediments or the like. Since, as mentioned, approximately rectangular plates are present in the exemplary embodiment shown, the flow paths 11 and the ducts 12, 13 are also located approximately perpendicularly with respect to one another.

In embodiments (not shown), the inlets and outlets 4, 5 are also arranged at a common edge E but in the vicinity of the corners of the plates 1 here, with the result that the lengths of the flow paths 11 becomes virtually zero. In other words, fluid can enter virtually directly into the first ducts 12 and virtually directly enter the outlets 5 from the second ducts 13. There would also be no reason, for example, not to arrange the inlets 4 in the corners and merely to position the outlets 5 approximately as shown, or vice versa. As a result, only significantly pronounced outlet-side flow paths 11 would be present while the length of the inlet-side flow paths 11 would approach zero, that is to say would be virtually invisible. The designer therefore has multiple options available for adapting the heat exchanger to restrictions forced on him by the installation location, without having to accept a loss of power.

Figure 4:
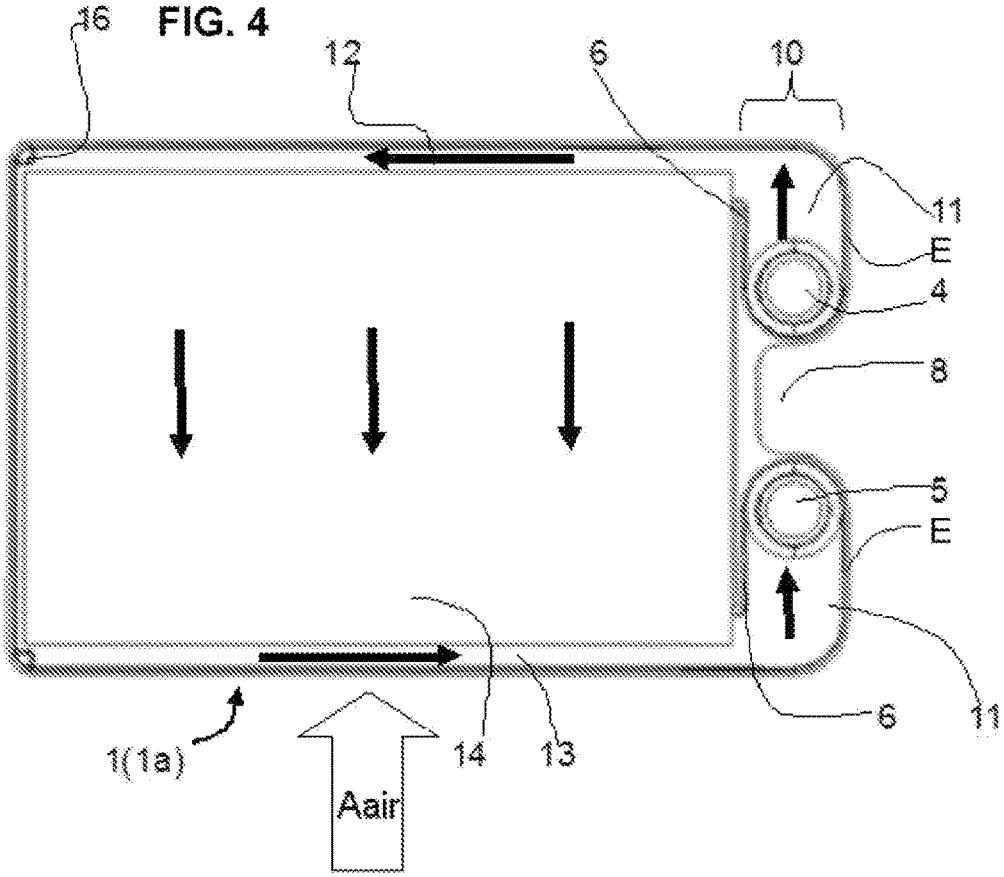
FIGS. 4 and 5 show two plates which form a plate pair.
Figure 5:
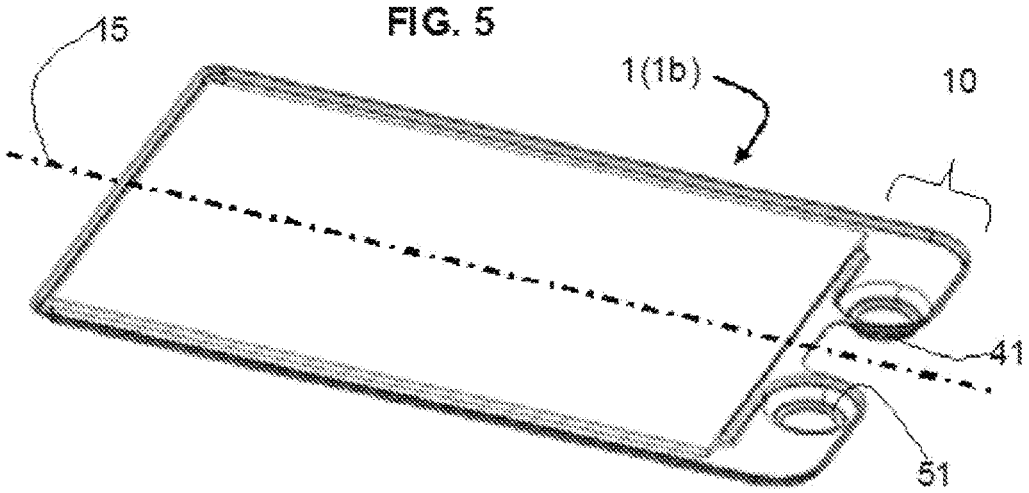

The flow paths 11 are preferably implemented by construction of beads in the plates 1 forming the pairs, as is apparent from the illustrations according to FIGS. 4 and 5. Instead of beads, rods which are inserted and soldered (or braised or welded) in the plate pairs can also be provided. In the exemplary embodiment shown, the beads or the rods form the flow barriers 6 mentioned above. These figures show plan views of the two plates 1 which form a plate pair 1*a*, 1*b*, with an internal fin 14 which is inserted therein, but is not illustrated in detail here.

The plate 1*b* shown in FIG. 5 is rotated through 180° about its longitudinal axis 15 and is positioned on the plate 1*a* in FIG. 4. The two beads come to bear one against the other in the plate pair 1*a*, 1*b* and are connected later. They accordingly have a height which is approximately half as large as the distance between the two plates 1 which form the plate pair 1*a*, 1*b*. The height of the internal fin 14 must correspond to this distance. In addition, the plates 1*a* and 1*b* come to bear one against the other with their edges and are connected to one another in a sealed fashion. In the exemplary embodiment they are bent-over edges.

Various other edge configurations are known from the prior art. These can alternatively be provided.

The inlet and outlet openings 4, 5 of the plate pair 1*a*, 1*b* are provided with collars 41, 51 which protrude upward at the upper plate 1*a* and downward at the lower plate 1*b*. The connection to the adjacent plate pairs 1*a*, 1*b* takes place at these collars. Sealing rings which are located between the plate pairs and connect the latter are also an alternative to such collars 41, 51. In embodiments which are not shown just one of the plates 1 has a bead whose height has to be correspondingly larger, that is to say which should correspond to the height of the internal fin 14. Of course, the entire stack, that is to say the plate pairs and the fins 2 located therebetween are connected to one another, preferably connected metallically, for example soldered (or braised or welded) in a soldering (or braising or welding) oven. The soldered-in (or braised-in or welded-in) internal fin 14 through which the fluid flows is located within each plate pair 1*a*, 1*b*.

Since the aforementioned internal fin 14 can have a smaller dimension than the plate 1 in which it is inserted owing to construction of the ducts 12, 13, the position of the internal fin 14 is indeterminate, which is disadvantageous. A correct position of the internal fin 14 the plate 1 can be implemented by virtue of the fact that inwardly protruding knobs or similar shaped elements 16 are formed in the corners of the plates 1 and serve as a stop for the internal fin 14. As a result, the preassembly of the heat exchanger improves. With this measure it is also possible to prevent an undesired bypass for the fluid, or at least largely suppress it.

Figure 3:
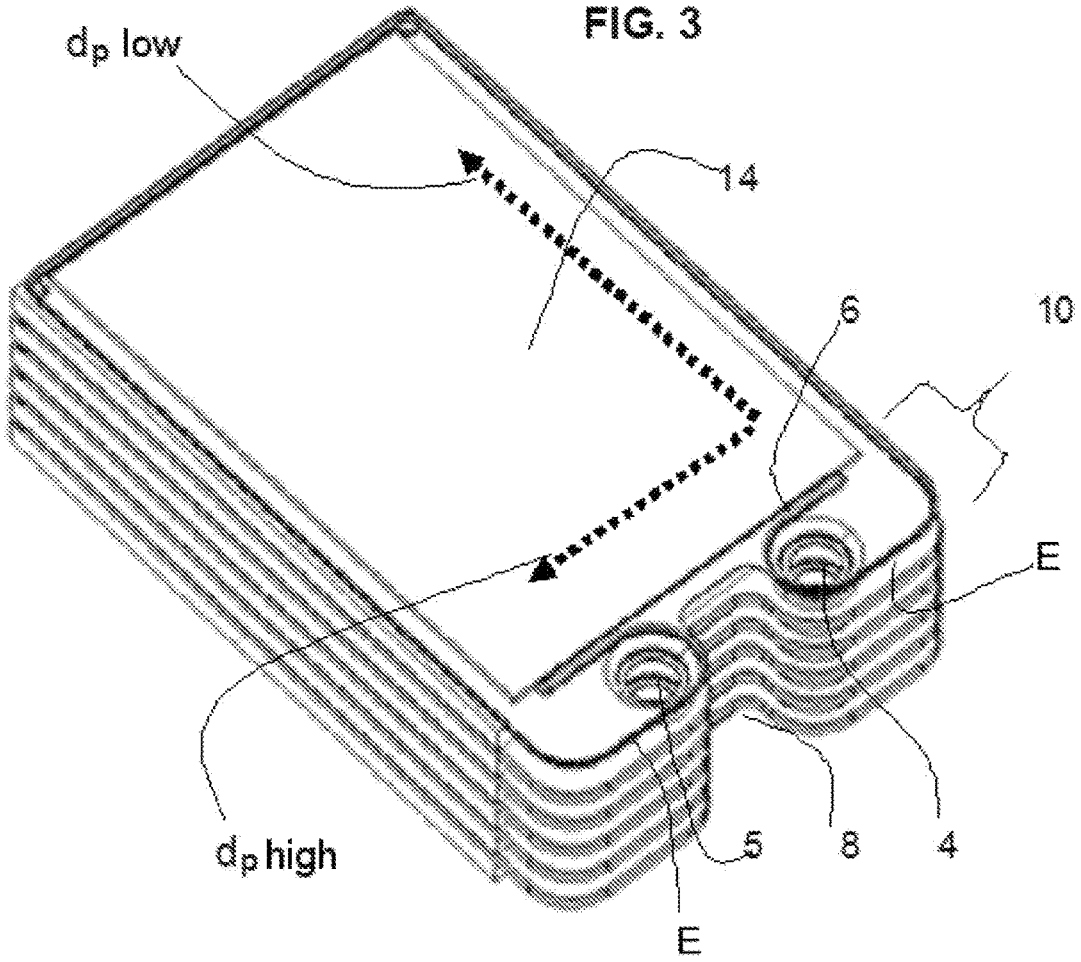
FIG. 3 shows a stack made of plates and fins in which the one plate of the upper plate pair has been removed in order to make the interior of this plate pair visible.

In FIGS. 3, 4 and 5, the inlet and outlet region which has already been mentioned is provided with the reference symbol 10. It makes up approximately 12% of the entire heat exchanging area here. Since this region for exchanging heat cannot contribute very much, the aim is to make it as small as possible. In FIG. 3, two arrows indicate that the corrugated internal fin 14 is preferably inserted into the plate pair 1*a*, 1*b* in such a way that when there is a flow through them in the longitudinal direction a significantly lower pressure loss dp occurs than when there is a throughflow in the lateral direction. The fluid is forced by the special design to take the path in the lateral direction and accordingly to flow though the plate pairs 1*a*, 1*b* in countercurrent with respect to the AAir.

Figure 6:
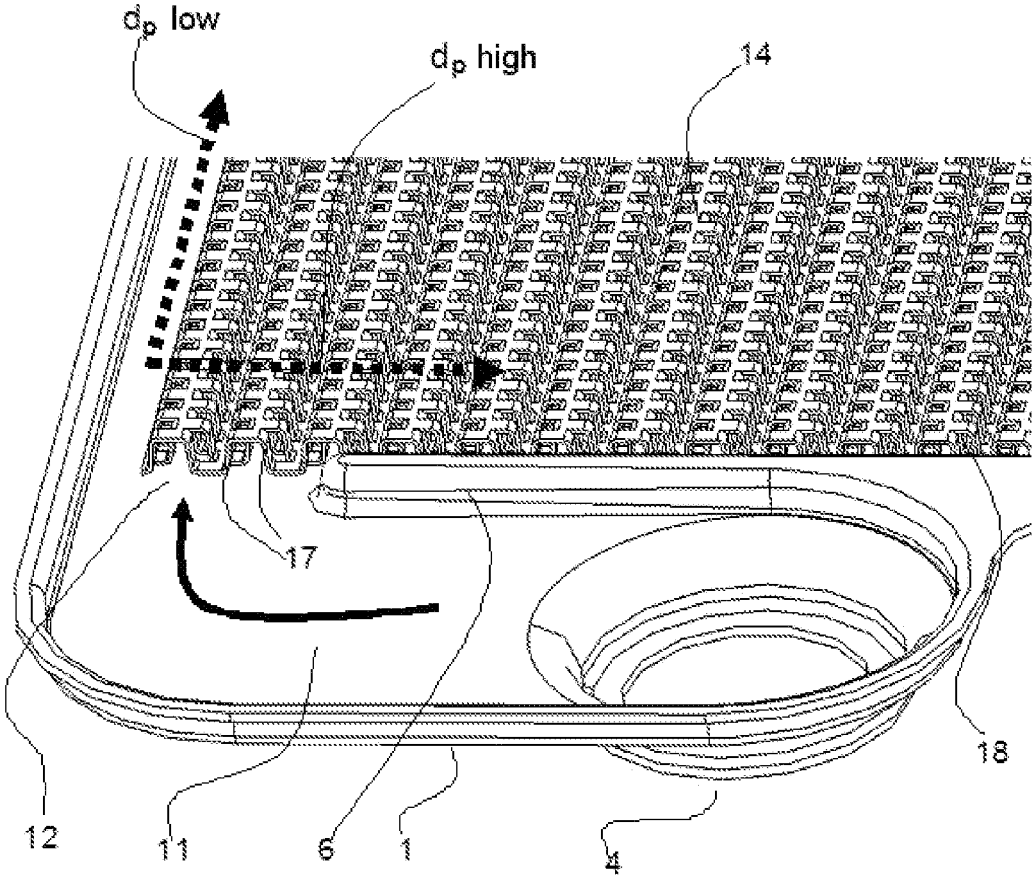
FIG. 6 shows a perspective view of a plate part with an internal fin.

FIG. 6 shows, in a section, a perspective view of the corrugated internal fin 14 which is located in the plate 1. Some details of the corrugated internal fin 14 can be seen. The direction in which the corrugation runs in the heat exchanger is the lateral direction thereof, that is to say the direction of the significantly higher pressure loss dp. In the corrugation edges 17 there are breakthroughs or cutouts 18 offset alternately to the left and to the right when viewed in the direction of said corrugation edge 17. The width of the ducts 12, 13 is determined by the distal end of the flow barrier 6 and the longitudinal edge of the plate. As is also shown by FIG. 6, a narrow strip of the duct 12 is completely free.

In embodiments according to the disclosure (not shown) the entire duct 12, 13 is of free design. In other embodiments (not shown) the longitudinal edge of the internal fin 14 extends directly to the longitudinal edge of the plates 1, with the result that the entire duct cross section is occupied by a section of the internal fin 14. The function of the ducts 12, 13 is retained because the aforementioned section points in the direction of the low pressure loss dp which corresponds to the direction of the duct. There is also the possibility of covering the cross section of the one duct completely with part of the internal fin 14 and leaving the other duct completely free.

Figure 2:
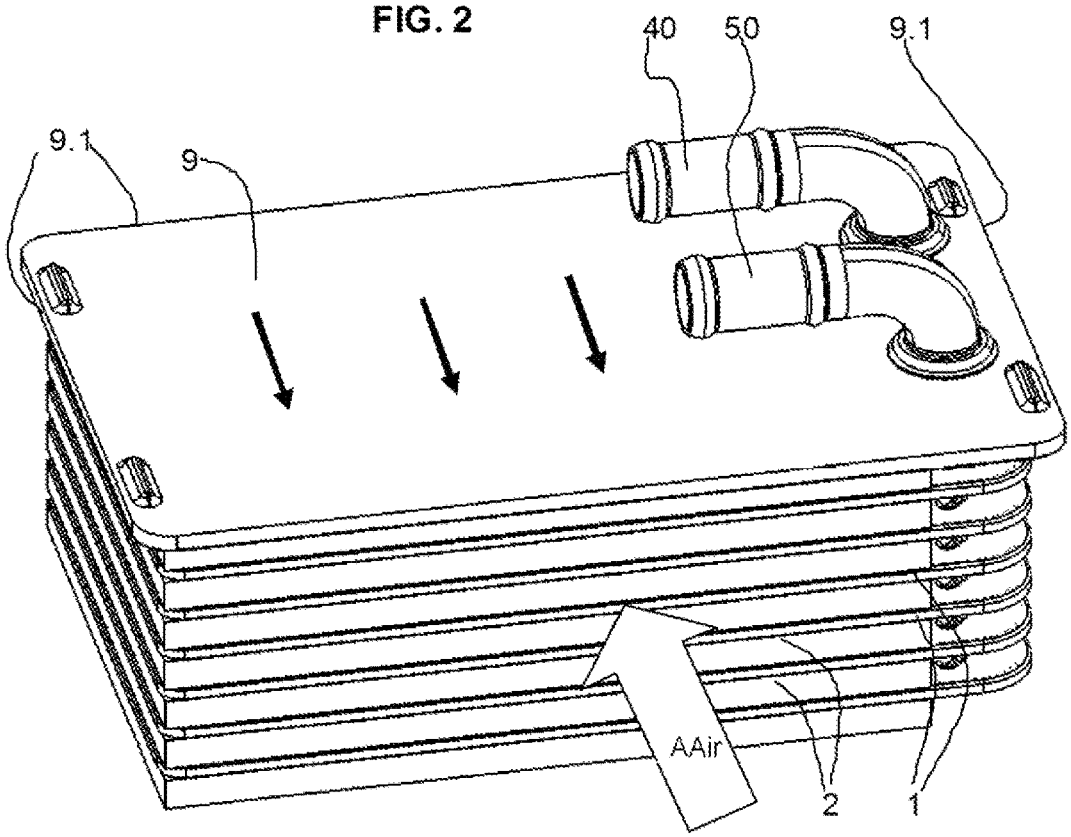
FIG. 2 shows a similarly perspective view with a cover plate on the stack of plate pairs and fins.
Figure 7:
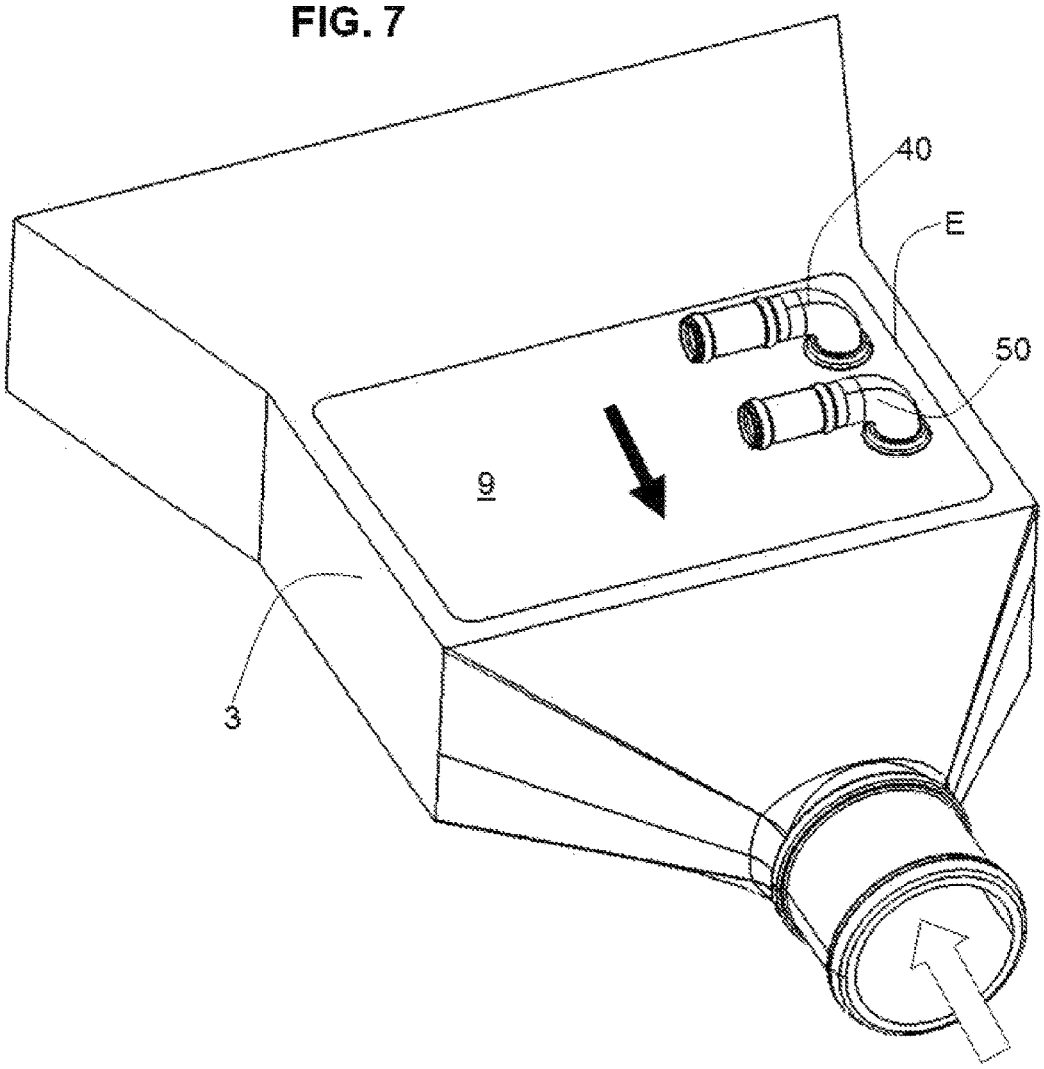
FIG. 7 shows a view of the heat exchanger in a suitable housing.

As is also the case in known heat exchangers, the compressed charge air AAir to be cooled flows through an opening into a housing 3 in which the aforementioned stack made of plate pairs 1*a*, 1*b* and fins 2 (not illustrated in more detail) are located (FIG. 7). The housing 3 can be the intake manifold of an internal combustion engine. According to the proposal, the charge air then flows through the corrugated fins 2 in countercurrent with respect to the fluid flowing in the plate pairs, and in the process it is cooled extremely efficiently. The direction of flow of the charge air is, also according to the proposal, provided in the direction of the common edge E at which the inlet 4 and the outlet 5 for the fluid are located, or in the exemplary embodiment in the direction of the lateral edges of the plates 1. As a result, the cooled charge air leaves the heat exchanger through another opening in the housing 3 in order to be available for charging the internal combustion engine (not shown). The protruding edge 9.1, of the cover plate 9 which can be seen in FIG. 2 and which terminates the stack and is connected metallically thereto, for example, can be used in a known fashion to attach the plate stack in the housing 3 and therefore serves as a closure of an assembly opening in the housing 3.

Figure 8:
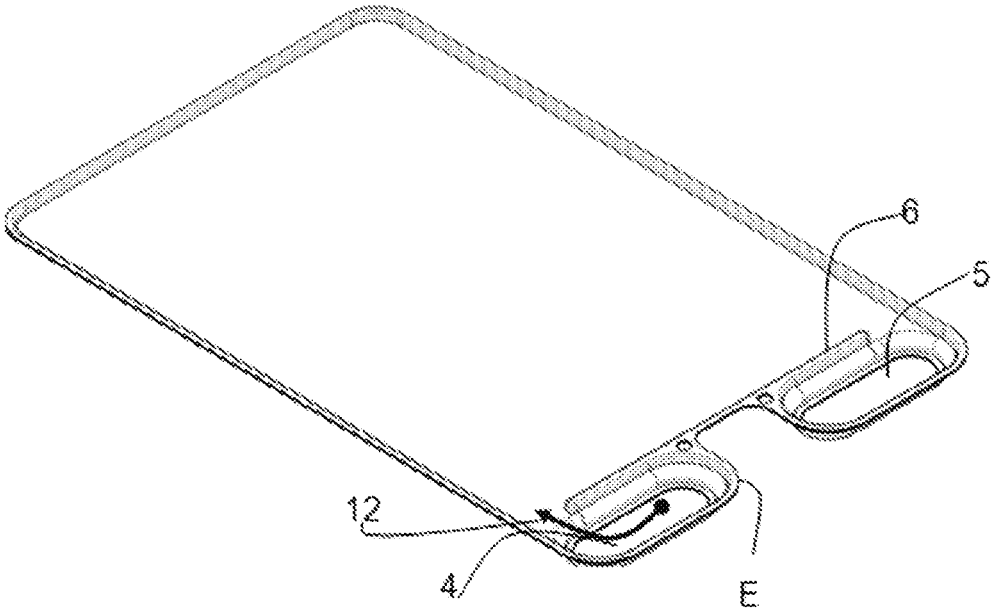
FIGS. 8 and 9 show modified plate configurations.
Figure 9:
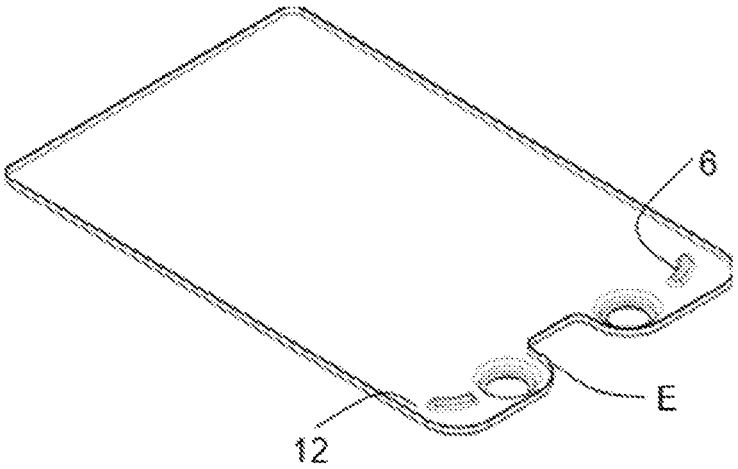

FIG. 8 shows a plate 1 with elongate holes as inlets and outlets 4, 5. The flow paths 11 have been virtually integrated into the elongate holes since there to a certain extent a flow guide is formed in the direction of the common edge E, as is also the case with the flow paths of the other exemplary embodiments. In embodiments which are not shown, the inlets and outlet 4, 5 have other different hole shapes. These may also include hole shapes which are configured asymmetrically. FIG. 9 in turn shows round plate holes 4, 5 but modified flow barriers 6.

What is claimed is:

1. A heat exchanger comprising:

stacked pairs of plates arranged in a housing configured to direct a flow of a first fluid through fins arranged between the stacked pairs of plates in a first fluid direction, each one of the pairs of plates having:

an inlet for receiving a second fluid;

an outlet for expelling the second fluid;

a flow barrier extending in the first fluid direction, the inlet and the outlet both being located between the flow barrier and a first lateral edge of the plates, the first lateral edge extending in the first fluid direction a first duct extending non-parallel with respect to the first lateral edge;

a second duct extending non-parallel with respect to the first lateral edge;

a heat transfer region bounded by the flow barrier and a second lateral edge of the plates opposite the first lateral edge and extending from the first duct to the second duct, wherein the heat transfer region has a larger heat exchange area than the first duct, the second duct, the inlet, and the outlet;

an inlet region extending from the inlet to the first duct and bounded by the flow barrier and the first lateral edge; and an outlet region extending from the second duct to the outlet and bounded by the flow barrier and the first lateral edge, wherein the pairs of plates are configured such that the second fluid is conducted from the inlet, through the first duct in at least partial cross current with respect to the first fluid, further through the heat transfer region in countercurrent with respect to the first fluid, through the second duct in at least partial cross current with respect to the first fluid, and to the outlet.

2. The heat exchanger of claim 1, wherein the first and second ducts are disposed perpendicularly with respect to the first lateral edge.

3. The heat exchanger of claim 1, wherein each of the pairs of plates extends in a plane defining a longitudinal axis, wherein the longitudinal axis is perpendicular to the first lateral edge.

4. The heat exchanger of claim 1, wherein the first and second ducts are formed in inner edge regions of the pairs of plates and are parallel to each other.

5. The heat exchanger of claim 1, wherein the first and second ducts have a lower flow resistance than the heat transfer region.

6. The heat exchanger of claim 1, wherein the inlet region and the outlet region take up not more than 15% of an effective heat exchange area of the pairs of plates.

7. The heat exchanger of claim 6, wherein the inlet region and the outlet region take up between about 4% and about 12% of the effective heat exchange area.

8. The heat exchanger of claim 1, further comprising internal fins arranged in the heat transfer region of the pairs of plates.

9. The heat exchanger of claim 8, wherein the internal fins include corrugations having offset cutouts configured to permit the second fluid to flow alternatingly between the first fluid direction and transverse to the first fluid direction.

10. The heat exchanger of claim 9, wherein the corrugations extend in the first fluid direction, wherein the flow resistance in the first fluid direction is relatively higher than the flow resistance in a direction transverse to the first fluid direction.

11. The heat exchanger of claim 1, wherein the flow barrier is at least partially formed from at least one of a bead or an inserted rod.

12. The heat exchanger of claim 1, wherein the pairs of plates include a cutout disposed between the inlet and the outlet.

13. The heat exchanger of claim 1, wherein the inlet and the outlet include substantially elongated holes formed in the direction of the first lateral edge, the elongated holes abutting the first and second ducts, respectively.

* * * * *